United States Patent [19]

Neilon

[11] 4,040,264

[45] Aug. 9, 1977

[54] CONTROLLED BUOYANCY UNDERWATER RISER SYSTEM

[75] Inventor: Claude R. Neilon, Houston, Tex.

[73] Assignee: Armco Steel Corporation, Middletown, Ohio

[21] Appl. No.: 635,843

[22] Filed: Nov. 28, 1975

[51] Int. Cl.[2] ..... E21B 7/12

[52] U.S. Cl. ..... 61/86; 61/112; 166/.5; 175/7

[58] Field of Search ..... 61/46, 46.5, 69, 72.3, 61/721, 86, 112; 166/.5, .6; 175/7, 6

[56] References Cited

U.S. PATENT DOCUMENTS

| | | | |
|---|---|---|---|
| 3,359,741 | 12/1967 | Nelson | 61/46 |
| 3,647,245 | 3/1972 | Hanes et al. | 61/46 |
| 3,858,401 | 1/1975 | Watkins | 166/.5 |
| 3,992,889 | 11/1976 | Watkins et al. | 61/86 |

*Primary Examiner*—Jacob Shapiro

*Attorney, Agent, or Firm*—Roylance, Abrams, Berdo & Kaul

[57] ABSTRACT

An underwater riser system in which the primary riser is surrounded by lengths of jacket pipe which form annular buoyancy chambers, there being a pressure fluid supply connected to the buoyancy chambers via valve means including at least a pressure differential valve which controls the amount of water displaced from the chamber by the pressure fluid. Advantageously, the valve means for each chamber also includes remotely controlled means by which the amount of buoyancy provided by the chamber can be varied at will, e.g., from a positive buoyancy to a buoyancy less than the operating weight of the portion of the riser system with which that chamber is associated. In best embodiments, the lengths of jacket pipe are interconnected into a continuous structural unit by connectors each having a female connector member secured to the upper end of the lower length of jacket pipe and a male member secured to the lower end of the upper length of jacket pipe, the female member having an annular bulkhead which closes the space between the jacket and primary riser pipe and on which the valve means is mounted.

15 Claims, 8 Drawing Figures

CONTROLLED BUOYANCY UNDERWATER RISER SYSTEM

BACKGROUND OF THE INVENTION

In the drilling of wells in formations beneath a body of water, it has become practice to employ, during drilling, a conduit which extends upwardly from the wellhead toward the vessel from which the drilling operation is being carried out, this conduit being of a diameter large enough to accommodate the drill string. Referred to as a riser, the conduit extends, under usual practices, for the entire distance from the well head to the vessel.

For a number of reasons, it is necessary to provide the riser with a predetermined buoyancy. Buoyancy is necessary to stabilize the riser, and to counteract the tendancy for the vessel and the riser to yield to lateral forces applied by currents and, at the vessel, by wind and waves. Best results have been achieved when buoyancy is distributed throughout at least a major portion of the length of the riser. A considerable amount of work and attention have been devoted by prior-art workers to the problem of providing underwater risers with buoyancy, and the state of the art is illustrated by the following U.S. Pat. Nos.

Re. 24,083, McNeil;
1,712,803, Wood;
1,746,132, Stokes;
1,764,488, Zublin;
2,187,871, Voorhees;
2,476,309, Lang;
3,017,934, Rhodes et al;
3,221,817, DeVries et al;
3,330,340, Hayes et al;
3,354,951, Savage et al;
3,359,741, Nelson;
3,501,173, Petersen et al;
3,605,413, Morgan;
3,768,842, Ahlstone;
3,858,401, Watkins;

Though some proposals of the prior-art have met with substantial success, there has been a continued need for improvement, particularly in view of the increasing underwater depths at which drilling is being carried out. One problem area is the need for surrounding the riser without having stresses set up in the riser pipe as a result of bending and elongation of the jacket structure. Another area of difficulty has been the problem of arriving at a structure in which buoyancy can be predetermined practically and with reasonable accuracy.

OBJECTS OF THE INVENTION

One object of the invention is to devise an underwater riser system in which the primary riser is provided with mutually independent buoyancy chambers throughout at least a substantial protion of its length and each buoyancy chamber can be supplied with pressure fluid, typically air, to provide an amount of buoyancy appropriate for that chamber under the control of valve means responsive to a control function dependent upon the difference in hydrostatic head at two points spaced along the length of the buoyancy chamber.

Another object is to provide such a system including means whereby, as a result of control functions accomplished on the floating vessel, the buoyancy at any of the plurality of buoyancy chambers can be changed from a value in excess of the operational weight at that chamber to a value less than the operational weight.

A further object is to devise such a riser system in which the buoyancy can be decreased without generating a flow of bubbles which would adversely affect operation of conventional acoustic systems employed to maintain position of the drilling vessel.

Yet another object is to provide such a buoyant riser system in which an outer jacket is employed to define the buoyancy chambers and the jacket is made up of lengths of jacket pipe interconnected to form a continuous structural unit, all subsurface buoyancy control components being accommodated by the annular space between the primary riser and the surrounding jacket.

A still further object is to devise such a riser system wherein each length of riser pipe is combined with a surrounding length of jacket pipe and a female connector member and a male connector member to form a sub-assembly which can be installed in the riser assembly in a simple and efficient manner.

Another object is to provide such a riser system wherein each length of riser pipe is suspended via rigid means from that portion of the jacket structure which surrounds the upper end of that length of riser pipe, the lengths of riser pipe being axially movable relative to each other so that stresses are not applied to the primary riser as a result of, e.g., bending of the jacket structure.

SUMMARY OF THE INVENTION

Stated generally, riser systems according to the invention comprise a plurality of lengths of primary riser pipe and a plurality of lengths of jacket pipe, each length of jacket pipe being connected rigidly at its upper end to a different one of the lengths of riser pipe so that the two lengths of pipe coact to define an annular buoyancy chamber. In the assembled riser system, a pressure fluid supply conduit extends lengthwise of the system throught the annular spaces between the lengths of riser pipe and the respective lengths of jacket pipe. At each buoyancy chamber, a differential valve device is mounted above and at the upper end of the chamber, the valve device having an inlet connected to the pressure fluid supply conduit and an outlet opening into the top of the chamber. Advantageously, the lengths of jacket pipe are rigidly interconnected by connectors each comprising a male connector member secured to the lower end of one length of jacket pipe and a female connector member secured to the upper end of the next lower length of jacket pipe each connector member having a transverse annular bulkhead which positions the corresponding ends of the respective riser pipe length and, e.g., the pressure fluid supply conduit. The valve device is mounted on the bulkhead of the female coupling member in a position between the riser pipe and the jacket pipe. Similarly mounted is at least one additional remotely operated valve having an inlet communicating with the interior of the buoyancy chamber and an outlet connected to the pressure fluid supply conduit.

In order that the manner in which the foregoing and other objects are achieved according to the invention can be understood in detail, particularly advantageous embodiments thereof will be described with reference to the accompanying drawings, which form part of the original disclosure of this application, and wherein.

THE EMBODIMENT OF FIGS. 1-7

Figure 1:
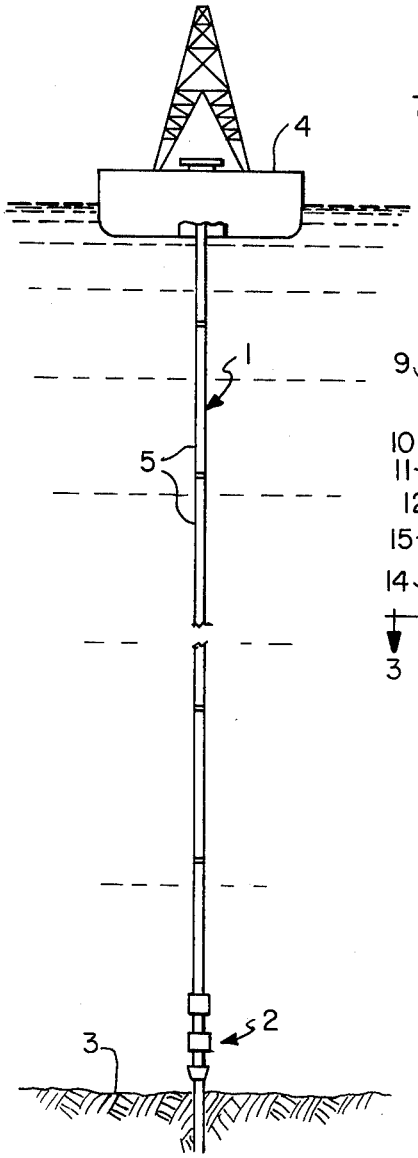
FIG. 1 is a side elevational view of a buoyant riser system constructed and installed according to the invention.

FIG. 1 illustrates a typical underwater riser system installed according to the invention, the riser system indicated generally at 1 extending from the wellhead 2, located adjacent the floor 3 of the body of water, upwardly to the conventional drilling vessel 4, the riser system being connected to the wellhead and the vessel in conventional fashion. Riser system 1 is made up of a plurality of identical sections 5 connected end-to-end.

Figure 2:
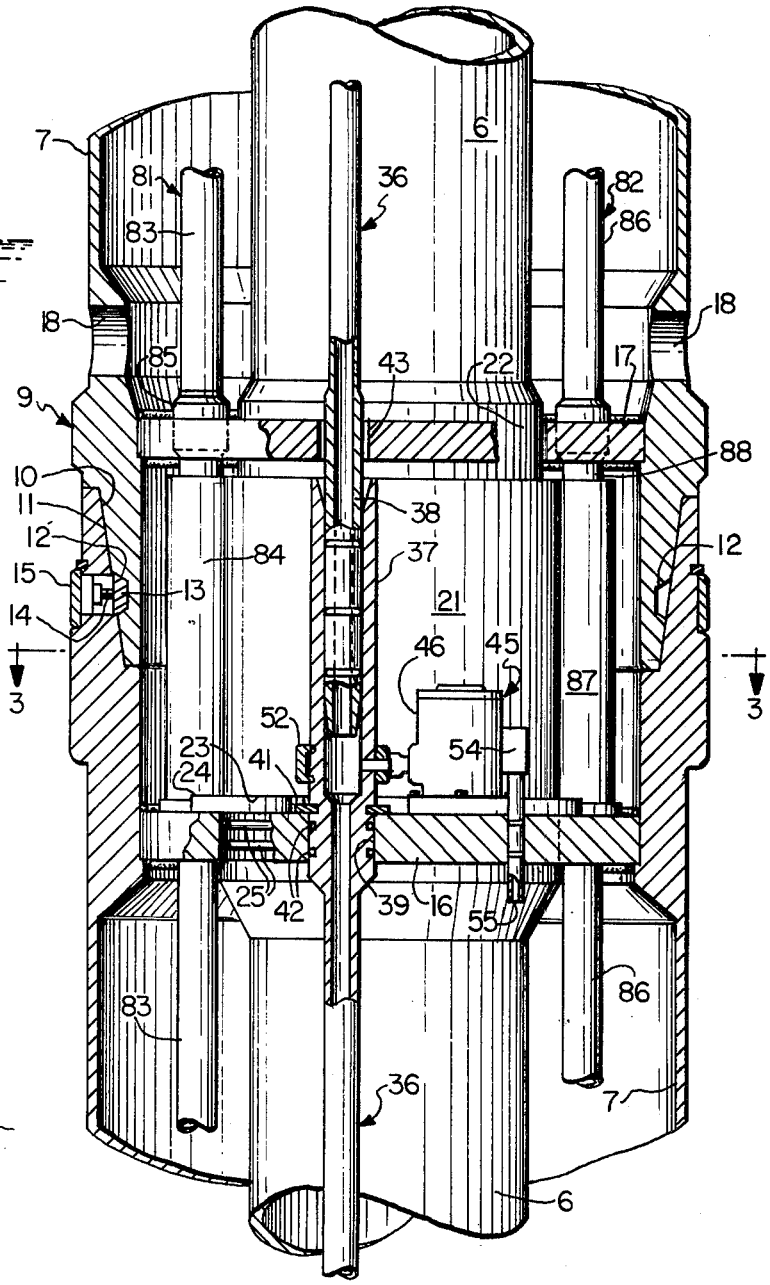
FIG. 2 is a vertical sectional view taken generally on line 2—2, FIG. 3, with parts broken away for clarity of illustration, showing the connection between two adjacent sections of the riser system of FIG. 1.
Figure 3:
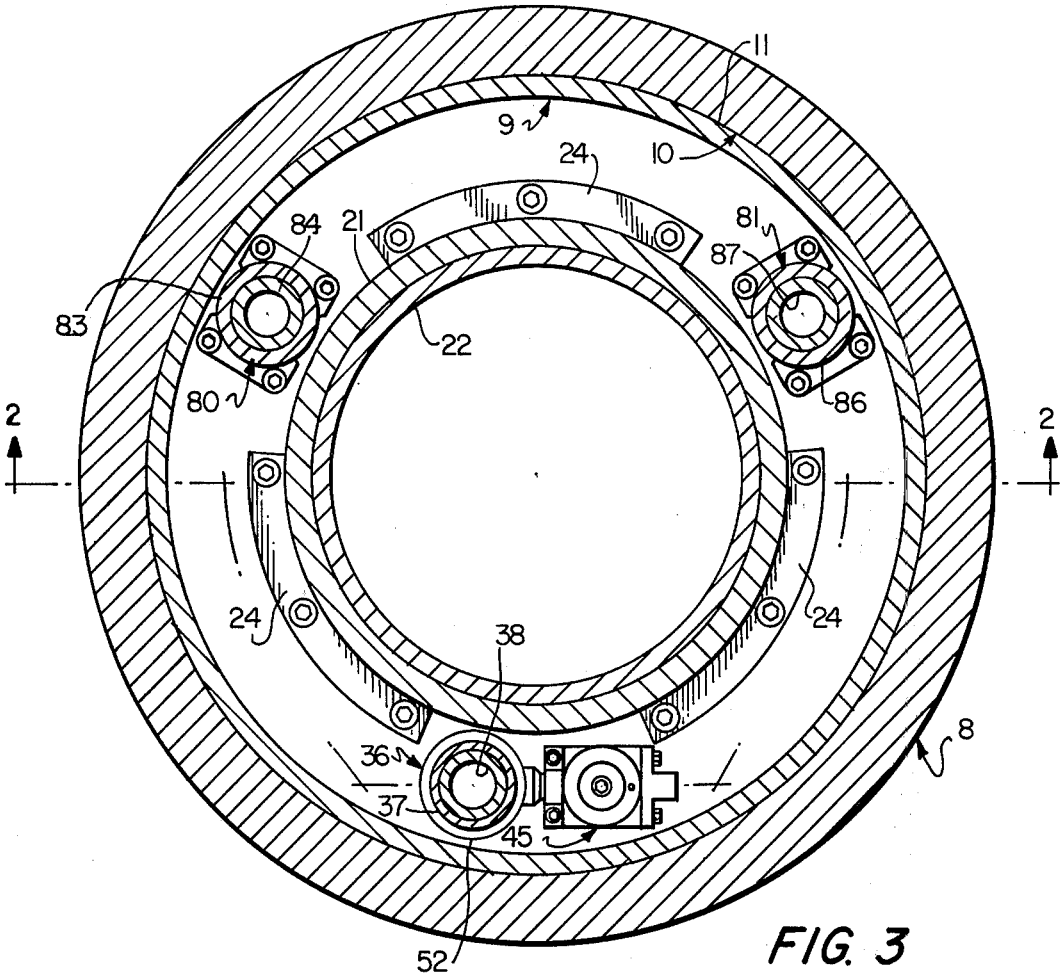
FIG. 3 is a transverse sectional view taken generally on line 3—3, FIG. 2.

Referring to FIG. 2, each section 5 comprises a length 6 of primary riser pipe and a length 7 of jacket pipe, the jacket pipe 7 being a substantially larger diameter than the riser pipe. In addtion, the section 5 comprises the female coupling member 8, welded to the upper end of jacket pipe 7, and a male coupling member 9, welded to the lower end of the jacket pipe. Each female coupling member 8 presents an upwardly and outwardly tapering frusto-conical bowl 10 into which the downwardly and inwardly tapering frusto-conical portion 11 of the corresponding male member 9 can be inserted to bring the frusto-conical surfaces into flush engagement. Male member 9 has a transverse annular outwardly opening locking groove 12 and female member 8 carries a plurality of arcuate locking members 13 forced inwardly by screws 14 so as to engage in the groove 12 and lock the two coupling members together. The screw machanism for actuating locking members 13 can be of any conventional type designed for manual operation before the section is immersed, and is enclosed by an outer cover ring 15. Female coupling member 8 is equipped with a transverse annular bulkhead 16 which is welded at its periphery to the coupling member and which completely closes in sealed fashion the annular space between the female coupling member and the adjacent riser pipe coupling. Male coupling member 9 is equipped with a transverse annular bulkhead 17 welded at its periphery to the male coupling member and provided with openings which loosely embrace the riser pipe coupling and other internal components, so that the space between bulkheads 16 and 17 is in liquid flow communication with the annular space above bulkhead 17. The annular portion of male coupling member 9 which projects above bulkhead 17 is provided with a plurality of circular ports 18 which all lie in a common plane at right angles to the longitudinal axis of the section 5 and communicate between the annular space between the riser and jacket pipes, on the one hand, and the space outside the jacket pipe, on the other hand.

Figure 4:
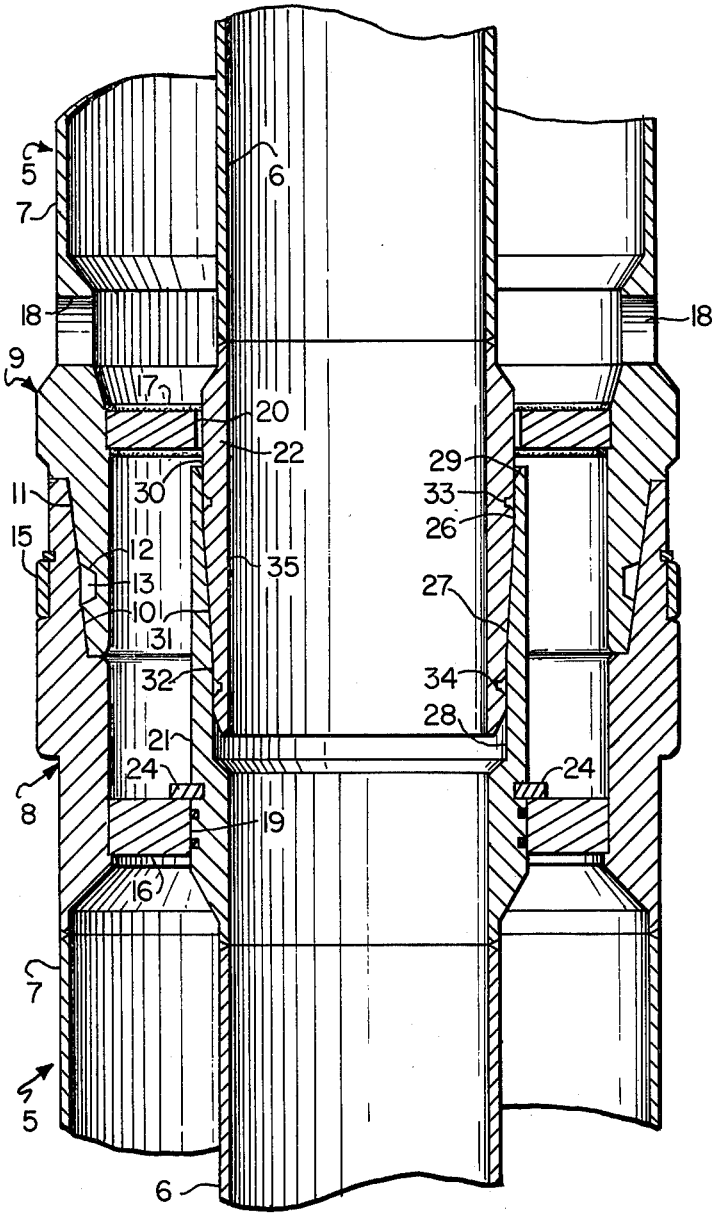
FIG. 4 is a vertical sectional view showing the connection between two adjacent lengths of primary riser pipe and the two associated adjacent lengths of jacket pipe, parts being omitted for clarity of illustration.

As seen in FIG. 4, each section of primary riser pipe 6 has, welded to its upper end, a female coupling member 21 and, welded to its lower end, a male coupling member 22. The main outer surface of member 21 is right cylindrical, of a diameter to be slidably accommodated by inner peripheral wall 19 of bulkhead 16, and is provided with a transverse annular groove 23, FIG. 2, to accommodate arcuate locking clips 24 which are bolted to the upper surface of bulkhead 16. Below groove 23, member 21 is provided with two transverse annular grooves 25, FIG. 2, each accommodating an O-ring which forms a pressure seal with the inner peripheral wall of bulkhead 16. Internally, female coupling member 21 has an upper right cylindrical surface portion 26, a downwardly and inwardly tapering frusto-conical surface portion 27, and a lower right cylindrical surface portion 28. Below portion 28, the internal diameter of member 21 is reduced to match the internal diameter of the primary riser pipe. A sharply outwardly tapering chamber 29 is provided at the upper end of member 21.

Male riser coupling member 22 has a right cylindrical outer surface portion 30 of a diameter substantially equal to that of surface portion 26 but significantly smaller than that of the inner peripheral wall 20 of bulkhead 16. Below portion 30, the outer surface of member 22 has a downwardly and inwardly tapering portion 31 and a lower right cylindrical portion 32, the latter being of a diameter substantially equal to that of portion 28. A transverse annular groove in surface portion 30 accommodates a conventional sealingring 33. Similarly, a groove in portion 32 accommodates a sealing ring 34. The internal wall 35 of member 22 is of a diameter equal to that of the primary riser pipe.

Members 8 and 9 constitutean outer coupling which rigidly interconnects the two adjacent lengths 7 of jacket pipe, and each adjacent pair of lengths of jacket pipe are rigidly interconnected in like fashion. Hence, the combination of pipes 7 and coupling members 8 and 9 forms a continuous rigid structure extending for the full length of the riser assembly. Each length of riser pipe 6 is individually suspended from the jacket structure, via a lower inner connector member 21, bulkhead 16 and lower outer connector member 8. The inner coupling members 21 and 22 are so positioned in the completed assembly that a small gap is present between frusto-conical surfaces 27 and 31. Accordingly, there is freedom of relative axial movement between coupling members 21 and 22 and, therefore, between the two riser pipes 6 which those members connect. As a result of such freedom of movement, forces resulting from bending or elongation of the jacket structure are imparted to the riser pipes 6 individually and not to the primary riser as a whole, the outer jacket constituting the primary strength member of the assembly, and the riser pipes and associated inner connectors being protected from distortion. Since seals 33 and 34 work on right cylindrical surfaces, the riser pipe coupling remain fully sealed despite relative axial movement members 21 and 22.

Each section 5 of the riser system also comprises a section of pressure fluid supply conduit 36, FIG. 2, having welded to its upper end a female connector member 37 and to its lower end a male connector member 38. Bulkhead 16 is provided with a cylindrical opening 39, FIG. 2, which slidably embraces the lower end portion of female connector member 37, the connector member being grooved to accommodatte O-rings, at 42, which coact with the wall of opening 39 to provide a pressure seal. Connector member 37 is also grooved to accommodate locking clips 41 which are bolted to bulkhead 16 to secure the connector member and conduit 36 to the bulkhead. Above bulkhead 16, the internal diameter of connector 37 is enlarged to accommodate male connector member 38, the latter being grooved and provided with O-rings at 42 to provide pressure seals between the two connector members. Bulkhead 17 has a cylindrical opening 43 of a diameter significantly larger than the outer diameter of male connector member 38, that connector member passing freely through opening 43.

Figure 5:
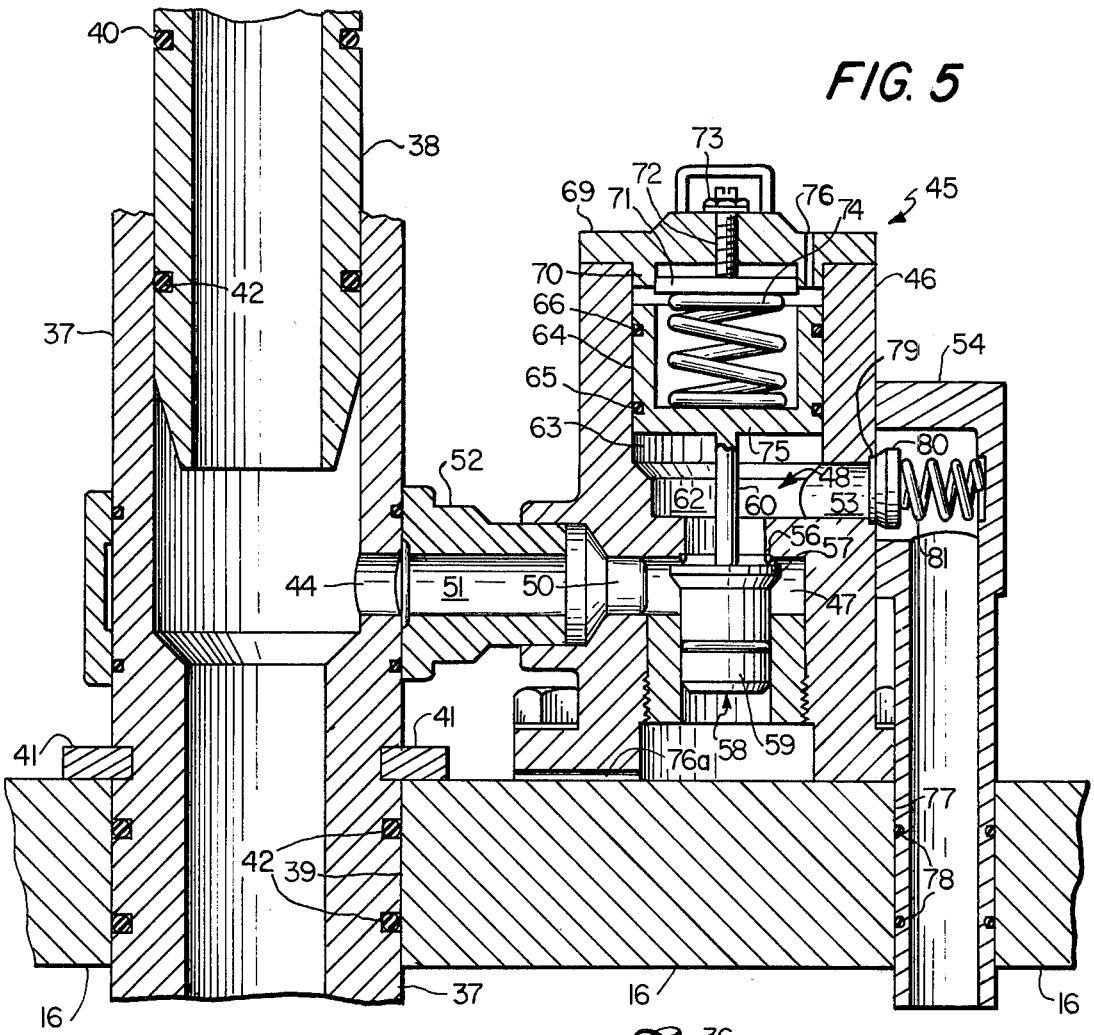
FIG. 5 is a fragmentary vertical sectional view, enlarged with reference to FIG. 2, illustrating a pressure differential valve forming part of each section of the riser system of FIG. 1.

Female connector member 37 has a lateral port 44 to which is connected the inlet port of a normally open pressure differentail valve 45 which is bolted to the upper side of bulkhead 16. Valve 45, shown in detail in FIG. 5, comprises an upright main body 46 defining a lower chamber 47 and an upper chamber 48 separated by a partition having an axial through bore 49. A lateral inlet port 50 opens into chamber 47 and communicates with port 44 of connector member 37 via duct 51 of an inlet adaptor 52 clamped to member 37. A lateral discharge port 53 leads from upper chamber 48 to an outlet adaptor 54 from which a discharge pipe 55 depends. Through bore 49 is equipped with a downwardly facing valve seat 56 which cooperates with the valve element 57 of a movable valve assembly 58 comprising a cylindrical guide member 59, which is integral with element 57, a stem 60, and a piston 61.

Upper chamber 48 includes a lower right cylidrical portion 62, into which bore 49 and port 53 open, and an upper right cylindrical portion 63 of larger diameter than portion 62, portion 63 slidably accommodating piston 61. Piston 61 is cup-shaped, the right cylindrical outer surface 64 thereof being grooved to accommodate O-rings 65 and 66 to seal between the piston and the surrounding chamber wall.

The top of chamber portion 63 is closed by a cap 69 which has a cylindrical skirt 70 projecting into chamber portion 63. Skirt 70 slidably embraces a disc 71 carried by a threaded stem 72 engaged in a central bore in the cap and fixed in any axially adjusted position by a nut 73. A helical compression spring 74 is engaged between disc 71 and the bottom wall 75 of piston 61, to bias movable valve assembly 58 to its normally open position.

A duct 76 extends through cap 69 to place the portion of the chamber above piston 61 in communication with the space between bulkheads 16 and 17 and therefore, via the openings in bulkhead 17 which accommodate connector members 22 and 38, with the annular space between the riser and jacket pipes above bulkhead 17. Guide member 59 is provided with an O-ring to seal between the guide member and the surrounding bore, and the space below guide member 59 communicates, as via groove 76*a*, with the space between bulkheads 16 and 17.

Discharge pipe 55 extends downwardly through bore 77 in bulkhead 16 and terminates at a point immediately adjacent the lower face of the bulkhead, O-ring being provided at 78 to seal between pipe 55 and the wall of bore 77. A suitable valve seat 79 is provided at the outer end of discharge port 53, and the adaptor 54 is formed to accommodate a check valve comprising movable valve member 80 and compression spring 81, the arrangement being such that spring 81 urges valve member 80 against seat 79 to close the check valve against passage of fluid from pipe 55 into chamber 48.

Each section 5 of the riser system can include other tubular components enclosed by the jacket pipe, in addition to the primary riser pipe 6 and the pressure fluid supply conduit 36. Typically, a kill line 81 and a choke line 82 can be included, each extending through the annular space between the primary riser and jacket pipes and each comprising a length of pipe supported by the bulkhead 16. Thus, kill line 81 includes pipe 83 having a female connector member 84 welded to its upper end and a male connector member 85 welded to its lower end, female member 84 passing through a bore in bulkhead 16 and being sealed thereto by O-rings (not shown), and secured by locking clips, in the manner hereinbefore described with reference to female coupling members 21 and 37. Male coupling member 85 extends through and is loosely accommodated by a suitable bore in bulkhead 17. Similarly, choke line 82 includes pipe 86, female connector member 87 and cooperating male connector member 88.

Each section 5 of the riser assembly 1 is a unitary sub-assembly in which all of the tubular internal components, including primary riser pipe 6, pressure fluid supply pipe 36 and ancillary members, such as kill and choke pipes 80 and 81, respectively, are rigidly supported at their upper ends by bulkhead 16 and stabilized in approximate final positions at their lower ends by bulkhead 17. The riser assembly is thus made up easily by lowering each section 5 onto the sub-adjacent section 5, so that the male connector members 9, 22, 38 of the section being lowered engage in and mate with their corresponding female coupling members 8, 21 and 37 at the upper end of the sub-adjacent section 5. Since the couplings for the primary riser pipe, the pressure fluid supply line, and the ancillary lines are simple stab-in couplings, locking up of the jacket pipe coupling comprising members 8 and 9 serves to complete the assembly operation for each connected pair of sectons 5. It will be understood that, in making up assembly 1, each additional section 5 is installed on the vessel 4 as the riser assembly is lowered progressively, using conventional guide means and techniques, until the lowermost section 5 is connected to the wellhead.

As each section 5 becomes fully submerged, water enters the annular space between the primary riser pipe and the jacket pipe via the ports 18 of that section. Since check valve 79–81 is closed until pressure fluid is supplied via line 36, the air initially present in the annular space between the riser and jacket pipes is trapped, between the water flowing in via ports 18 and bulkhead 16, and is compressed to an extent depending on the depth at which the section 5 is submerged. As water enters via ports 18, it first fills the space between bulkheads 16 and 17 below the port 18, and then rises to a level substantially above the port 18 via which it entered. As additional sections 5 are installed in the assembly 1, so that sections are lowered progressively to greater depths, more water enters each section 5, the airtrapped in the section being correspondingly further compressed. Since, for each section 5, the water entering via port 18 immediately fills the space between the bulkheads 16 and 17 below those ports, the valve 45 of any section 5 will be subjected to the hydrostatic head existing outside the jacket pipe at the level of that valve as soon as the full jacket connector at the top of that section, including both connector member 8 and connector member 9, has been completely immersed. Thereafter, as that particular section 5 is lowered to a greater depth, the valve 45 thereof will always be subjected to the hydrostatic head prevailing outside the jacket pipe at the particular depth occupied by the valve.

Any pressure fluid which is of markedly lower density than water can be supplied via line 36 to provide desired buoyancy of the sections 5. For practical purposes, however, the pressure fluid is advantageously compressed air, supplied from a conventional air compressor and pressure tank (not shown) on vessel 4.

It will be understood that, for any underwater well installation, the depth of the wellhead is known in advance and the riser assembly is made up of a predetermined number of sections 5 selected to span the total vertical distance between the wellhead and a particular location below the vessel 4. Thus, the sections 5 are all of substantially the same length which can be, e.g., 40–50 ft., a minimum member of shorter "pup" sections being used to space out the desired total length for riser assembly 1.

Figure 6:
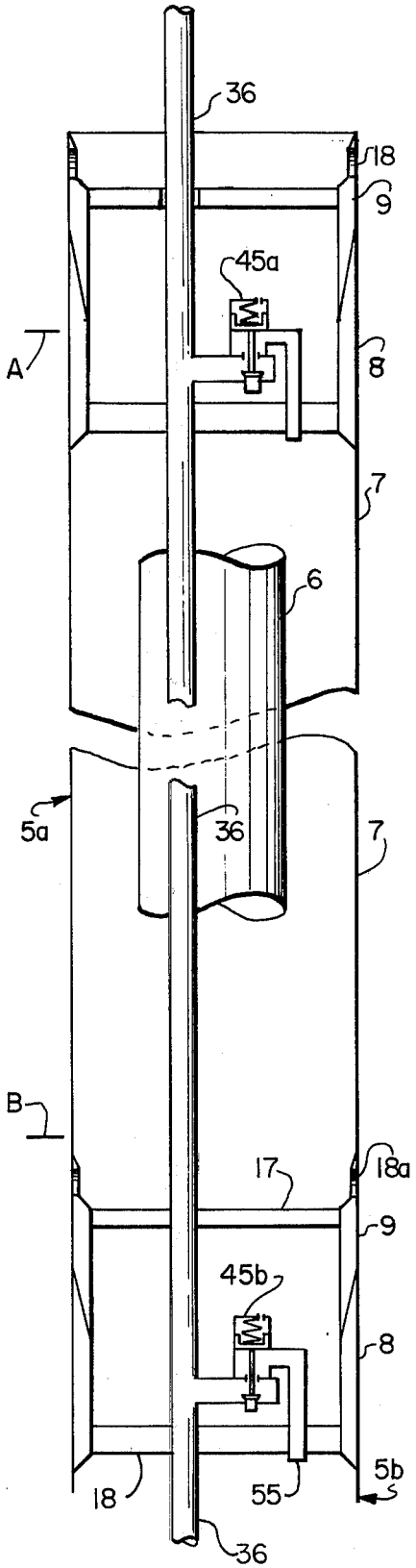
FIG. 6 is a semi-diamgrammatic vertical sectional view of a portion of the riser system of FIG. 1.

For each section 5, the valve 45 is designed and preadjusted to remain open until the effective pressure applied to the piston 61 by the pressure fluid supplied via line 36 reaches the value of the pressure at a point just above the ports 18 of that section 5. By design of the effective pressure areas of the surfaces of piston 61 and the movable valve assembly 58 and selection of the spring force applied by spring 74, this pressure differential is equated to, or made to have a predetermined proportional relation to, the difference in hydrostatic head pressure between the location of the valve 45 and a point above the ports 18 of that section 5. Thus, the predetermined pressure differential for the valve 45*a*, FIG. 6, can be related to the pressure head difference between points A and B, FIG. 6, when the section 5*a* of the riser assembly is at its predetermined final submerged location. It will be understood that, while each station 5 is intended to occupy a different location in the length of the riser assembly 1, the pressure differential which results in closing each valve 45 is identical because the lengths of all sections 5 are identical and the distances A-B are identical.

For explanation of a typical installation according to the invention, assume that the valves 45 of all sections 5 are identical, i.e., having the same piston pressure areas and adjusted spring force. With the riser assembly 1 fully assembled as shown in FIG. 1, air under pressure is supplied down line 36, initially at a pressure below that required to close any of the valves 45. Air accordingly flows first through valve 45*a* of the first riser section 5*a*, FIG. 6, into the annular space between the primary riser pipe and jacket pipe of that section, forcing water out of that space through the ports 18*a* at the bottom of section 5*a*. In forcing water out of section 5*a*, the compressed air passing through valve 45*a* works against an increasing hydrostatic head, and the air pressure within the inlet port 50 and chambers 47 and 48, FIG. 5, of the valve 45*a*, FIG. 6 therefore increases until, when the level of water within section 5*a* is forced down to point B, valve 45*a* closes, the air pressure acting on the piston of the valve having overcome the combination of the spring force applied by spring 74 and the hydrostatic force applied via port 76, FIG. 5. Further increase in the pressure of the compressed air supplied via line 36 than results in air flow through valve 45*b*, FIG. 6, into the annular space between the primary riser pipe and jacket pipe of section 5*b*, so that water is similarly forced out of that section until the air pressure at valve 45*b* becomes large enough to close that valve. This action continues successively, section by section, down the riser assembly until the water has been forced out of all the sections to the extend predetermined by the parameters of the respective valves 45.

Whenever the valve 45 of any section 5 of the riser assembly closes, terminating the supply of compressed air to the annular chamber of that section, the pressure in chamber 48 of that valve is no longer adequate to maintain check valve 79–81 open against the force of spring 81 and the positive pressure at the outlet end of pipe 55. Accordingly, the check valve closes whenever that section 5 has been supplied with the desired buoyancy. With the check valves 79–81 of all valves 45 closed, it is no longer necessary to maintain positive pressure in line 36 and that line can be used for other purposes.

THE EMBODIMENT OF FIG. 7

When vessel 4 employs an acoustic station-keeping system to maintain the vessel in position over the wellhead, it is necessary to avoid any significant generation of air bubbles during reduction of the amount of buoyancy or withdrawal of the riser assembly 1, since such bubbles would tend to defeat proper operation of the station-keeping system.

Figure 7:
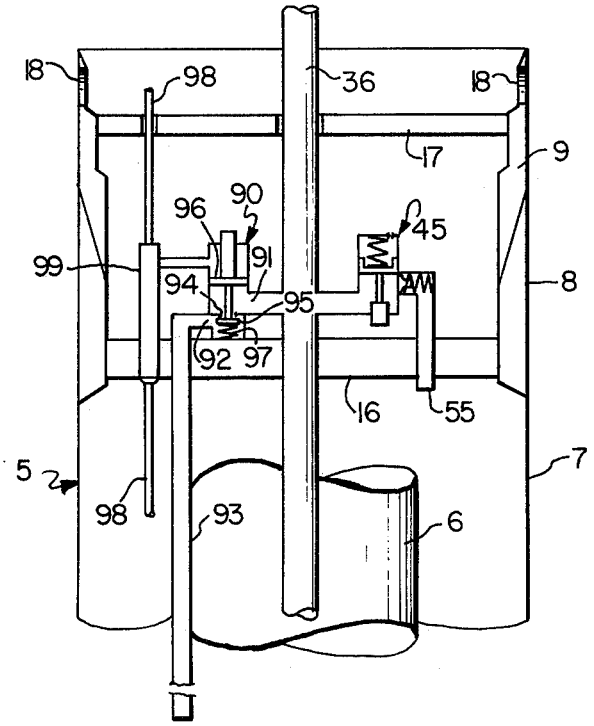
FIG. 7 is a view similar to FIG. 6 illustrating a second embodiment of the invention.

FIG. 7 illustrates an embodiment of the invention which makes it possible to provide any of the sections 5 of the riser assembly 1, FIG. 1, with an initial buoyancy in excess of the total operating weight of that section and then to reduce that buoyancy to a smaller value, which may be less than the operating weight of the section. This embodiment employs all of the components described with reference to FIGS. 1–6 and, in addition, means by which compressed air in section 5 can be evacuated in a controlled fashion via line 36. Depending upon the particular circumstances involved, selected ones of the sections 5, or all of the sections 5, are provided with a remotely controlled normally closed valve 90 mounted on bulkhead 16 and having a port 91 connected to line 36 and a port 92 connected to a pipe 93 which extends through bulkhead 16 and depends therefrom to a predetermined point spaced below bulkhead 16 and above ports 18. Valve 90 has a fixed valve seat 94 co-operating with a movable valve member 95 connected to a piston 96, the combination of the movable valve member and the piston being biased upwardly by spring 97 to maintain valve 90 normally closed. The valve casing defines a cylinder in which piston 96 works, and the space in the cylinder above the piston is connected to a conduit 98 by which a fluid under pressure can be supplied to drive the piston downwardly and open the valve in response to a remote control action accomplished on vessel 4. Pipe 93 and conduit 98 are equipped with pressure seals (not shown), such as O-rings in the manner hereinbefore described with reference to pipe 55 and line 36, to maintain the completely sealed nature of bulkhead 16. Bulkhead 17 has a bore which loosely embraces conduit 98, and that conduit extends effectively throughout the entire riser assembly, the individual sections of the conduit being interconnected by stab-in type connectors 99.

The amount of buoyancy initially provided any section 5 is determined by its annular volume and the parameters of the corresponding valve 45. The amount of the reduction in buoyancy obtained by opening valves 90, with line 36 now vented to the atmosphere, is determined by the predetermined location of the lower end of pipe 93 in the respective section 5. With control pressure applied to conduit 98, all valves 90 of the riser assembly are opened substantially simultaneously, and water begins to flow inwardly through the ports 18 of all of the sections as soon as the respective valves 90 open. Inflow of water via ports 18 causes air to be forced out via the pipes 93 and valves 90 into line 36 and, via that line, to the atmosphere. When, in each section 5, the water rises to the level of the lower end of pipe 93, the water will effectively close the end of pipe 93 so no further air can be exhausted from that section, and the water then flows through pipe 93 and valve 90 into line 36, until line 36 is filled or valve 90 is closed by remote operation from vessel 4.

If it is desired to again increase the buoyancy of the riser assembly, line 36 can again be connected to the vessel-mounted source of compressed air and, with valves 90 still closed, the compressed air will again force water out of the sections via valves 45 and ports 18.

THE EMBODIMENT OF FIG. 8

Figure 8:
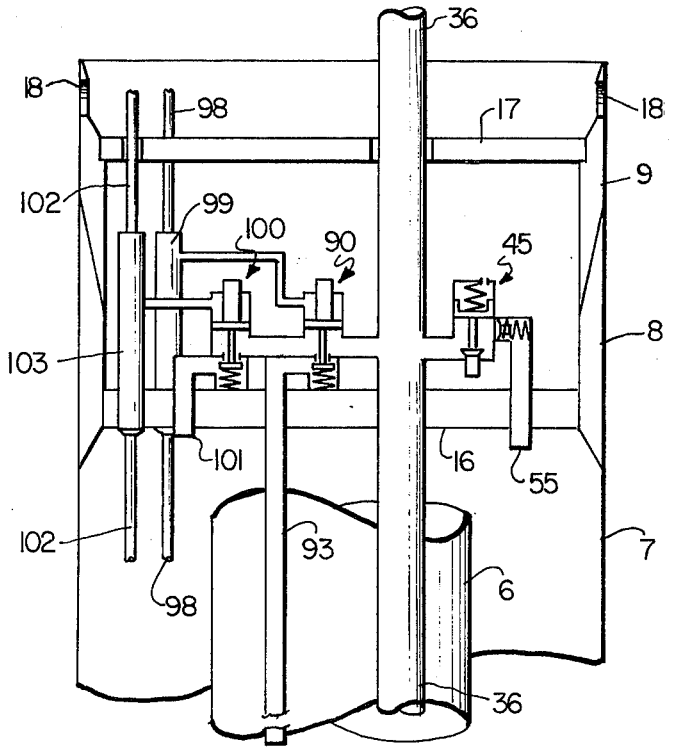
FIG. 8 is a view similar to FIG. 6 illustrating another embodiment.

In the embodiment illustrated in FIG. 8, an additional normally closed remotely operated valve 100 is employed for each section 5 of the riser assembly to provide for conducting air from the respective riser section into line 36 and from line 36 to the atmosphere. Mounted on bulkhead 16, valve 100 is identical with valve 90 but is connected to line 36 via the cavity of valve 90 above the valve seat and to the annular space of the respective section 5 via a pipe 101 which terminates immediately below bulkhead 16. Valve 100 is operated remotely via pressure fluid conduit 102 which extends for the full length of the riser assembly, each adjacent pair of sections of conduit 102 being interconnected by a stab-in connector 103. It will be apparent that valves 100 can be operated remotely from vessel 4, independently with respect to valves 90, to accomplish partial or total ballasting of the riser assembly 1, when ballasting must be accomplished without generation of air bubbles.

While particularly advantageous embodiments of the invention have been described for illustrative purposes, it will be understood by those skilled in the art that various changes and modifications can be made therein without departing from the scope of the invention as defined in the appended claims.

What is claimed is:

1. In an underwater well riser system to be run between a floating vessel and an underwater well installation, the combination of a primary riser comprising a plurality of lengths of riser pipe; an outer jacket comprising a plurality of lengths of jacket pipe of substantially larger diameter than said riser pipe;

a plurality of connector assemblies each adapted to interconnect two adjacent lengths of said riser pipe and to secure the upper end of one of said lengths of jacket pipe to the upper end of the corresponding one of said lengths of riser pipe with said length of jacket pipe spaced outwardly from said one length of riser pipe and depending from the connector assembly, there being an annular space between said one length of riser pipe and said one length of jacket pipe, there being at least one opening communicating between said annular space and the water external to said jacket pipe in a location spaced from the top of said one length of jacket pipe;

a pressure fluid supply line comprising a plurality of lengths of pressure fluid supply pipe of a diameter such as to be accommodated in said annular space and of a length such that said connector assemblies can interconnect adjacent lengths of said pressure fluid supply pipe; and a plurality of pressure differential valves each mounted on a different one of said connector assemblies, each of said pressure differential valves comprising an inlet connectable to said pressure fluid supply line, an outlet connectable to said annular space below the one of said connector assemblies on which the valve is mounted, and valve operating means responsive to the difference between the water pressure in the location occupied by the valve and the fluid pressure at said outlet;

supply of pressure fluid in one direction via said pressure fluid supply line in the assembled riser system, when the system is submerged, causing water in said annular spaces to be forced out through said at least one opening of each annular space, whereby said spaces are rendered buoyant to a degree determined by operation of said pressure differential valves.

2. The combination defined in claim 1, wherein said connector assemblies each include cooperating connector members for interconnecting adjacent lengths of said jacket pipe.

3. The combination defined in claim 2, wherein said at least one opening is a lateral port adjacent the bottom end of the respective length of jacket pipe.

4. The combination defined in claim 2, wherein said valves are located in positions aligned with said annular spaces.

5. The combination defined in claim 1, wherein each of said connector assemblies comprises a first connector member secured to the upper end of a length of jacket pipe, a second connector member secured to the lower end of a respective length jacket pipe, means for locking said connector members together in sealed relation, a transverse annular bulkhead secured to and extending across the interior of said first connector member, and a coupling member carried by said bulkhead for interconnecting two adjacent lengths of said riser pipe.

6. The combination defined in claim 5, wherein said pressure differential valves are each mounted on a different one of said bulkheads in the space between the riser and jacket pipes.

7. The combination defined in claim 6, wherein each of said connector assemblies comprises a second transverse annular bulkhead secured to the second connector member of the connector assembly, said second bulkhead loosely embracing the primary riser in the assembled system, whereby the space between said first and second bulkheads of each of said connectors communicates with the next super-adjacent one of said annular spaces, said valve operating means of said pressure differential valves each being disposed in the respective one of said annular spaces between the first and second bulkhead of a different one of said connector assemblies.

8. The combination defined in claim 1 and further comprising a plurality of remotely operated valves each mounted on a different one of said connector assemblies and each having first and second flow ports;

a plurality of pipes each of a predetermined length, each of said last-mentioned pipes being mounted on a different one of said connector assemblies and depending therefrom into the annular space between the corresponding lengths of riser and jacket pipes to terminate at a predetermined point above the next subadjacent connector assembly;

means connecting one flow port of each of said remotely operated valves to said pressure fluid supply line;

means connecting the other of said flow ports of each of said remotely operated valves to a different one of said last-mentioned pipes, whereby fluid can flow from the corresponding annular space through said last-mentioned pipe and into said pressure fluid supply line only when the respective one of said remotely operated valves is open; and control means connected to said remotely operated valves for operating the same from the floating vessel.

9. The combination defined in claim 8, wherein said remotely operated valves are normally closed; and said control means comprises a control fluid line connected to all of said remotely operated valves for opening the same substatially simultaneously.

10. The combination defined in claim 8, and further comprising a second plurality of remotely operated valves each mounted on a different one of said connector assemblies;

a plurality of flow conduit means each carried by a different one of said connector assemblies and each communicating between said pressure fluid supply line and a point immediately below said connector assembly in the corresponding one of said annular spaces, each of said second plurality of remotely operated valves being connected in a different one of said flow conduit means to control the flow of fluid therethrough; and second control means connected to said second plurality of remotely operated valves for operating the same from the floating vessel independently of said first-mentioned remotely operated valves.

11. The combination defined in claim 1 and further comprising a plurality of check valves each connected between said outlet of a different one of said pressure differential valves and the corresponding one of said annular spaces and each oriented to prevent flow of fluid from that annular space through the pressure differential valve to said pressure fluid supply line.

12. In an underwater riser assembly to be run between a floating vessel and an underwater well installation, the combination of a primary riser comprising a plurality of lengths of riser pipe;

an outer jacket comprising a plurality of lengths of jacket pipe of substantially larger diameter than said riser pipe;

a plurality of connector assemblies each adapted to interconnect two adjacent lengths of said riser pipe and to secure the upper end of one of said lengths of jacket pipe to the upper end of the corresponding one of said lengths of riser pipe with said length of jacekt pipe spaced outwardly from said one length of riser pipe and depending from the connector assembly, there being an annular space between said one length of riser pipe and said one length of jacket pipe, there being at least one opening communicating between said annular space and the water external to said jacket pipe in a location spaced from the top of said one length of jacket pipe;

a pressure fluid supply line comprising a plurality of lengths of pressure fluid supply pipe of a diameter such as to be accommodated in said annular space and of a length such that said connector assemblies can interconnect adjacent lengths of said pressure fluid supply pipe;

valved means carried by each of said connector assemblies for supplying pressure fluid from said pressure fluid supply line to the one of said annular spaces immediately below that connector assembly to force water out of that annular space and provide a predetermined buoyancy; and remotely operated means carried by at least a plurality of said connector assemblies for allowing a controlled amount of fluid to escape from the corresponding one of said annular spaces via said pressure fluid supply line to reduce the buoyancy at said annular space.

13. The combination defined in claim 12, wherein each of said remotely operated means comprises a pipe depending from the connector assembly into the corresponding one of said annular spaces and having an open end located at a predetermined distance above the bottom of that annular space, and means including a remotely operated valve for connecting the upper end of said last-mentioned pipe to said pressure fluid supply line.

14. In an underwater riser assembly to be run between a floating vessel and an underwater well installation, the combination of a primary riser comprising a plurality of lengths of riser pipe;

an outer jacket comprising a plurality of lengths of jacket pipe of substantially larger diameter that said riser pipe;

a plurality of outer connectors each rigidly interconnecting a different adjacent pair of said lengths of jacket pipe and each comprising an upper connector member and a lower connector member;

a plurality of inner connectors each interconnecting a different adjacent pair of said lengths of riser pipe and each comprising an upper connector member and a lower connector member, said upper and lower connector members of said inner connectors being interengaged telescopically and constructed and arranged for relative axial movement; and a plurality of bulkheads each rigidly interconnecting a different corresponding pair of said lower outer connector members and said lower inner connector members;

said lengths of jacket pipe and said outer connectors coacting to form a continuous outer jacket structure constituting the primary strength member of the riser assembly;

each of said lengths of riser pipe being suspended from the one of said outer connector members which surrounds the upper end of that length of riser pipe via the corresponding one of said bulkheads, whereby stresses resulting from bending or changing in length of said jacket structure are imparted to said lengths of riser pipe individually and the capability of relative axial movement between said upper and lower connector members of said inner connectors prevents such stresses from being imparted to the primary riser as a whole.

15. The combination defined in claim 14, wherein said bulkheads divide the annular space between said primary riser and said outer jacket into individual compartments, there being at least one opening communicating between each of said compartments and the water external to the jacket pipe in a location spaced from the top of that compartment;

the combination further including pressure fluid supply means; and valved means for supplying pressure fluid from said supply means to said compartments to force water out of the compartments and provide a predetermined buoyancy.

* * * * *